United States Patent [19]

Seabeck

[11] Patent Number: 4,743,723

[45] Date of Patent: May 10, 1988

[54] SWITCH ASSEMBLY WITH UNITARY CONTACT GUIDE

[75] Inventor: Lee A. Seabeck, Mentor, Ohio

[73] Assignee: Torg Corporation, Bedford, Ohio

[21] Appl. No.: 54,100

[22] Filed: May 18, 1987

Related U.S. Application Data

[63] Continuation of Ser. No. 843,240, Mar. 24, 1986, abandoned.

[51] Int. Cl.[4] ..... H01H 1/50

[52] U.S. Cl. ..... 200/250; 200/153 V; 200/241; 200/243; 200/275; 200/6 R; 200/290

[58] Field of Search ..... 200/159 A, 159 R, 153 V, 200/239–242, 335, 332, 330, 243, 245, 246, 247, 275, 250, 6 R, 6 B, 6 B B, 6 C, 16 R, 283, 290; 178/101, 102, 109, 110

[56] References Cited

U.S. PATENT DOCUMENTS

| | | | |
|---|---|---|---|
| 2,452,425 | 10/1948 | Berkholder | 200/246 X |
| 2,547,765 | 4/1951 | Lund | 200/335 |
| 2,695,939 | 11/1954 | Filliette | 200/244 |
| 2,734,959 | 2/1956 | Immel | 200/243 X |
| 3,018,353 | 1/1962 | Mitchell | 200/247 |
| 3,922,514 | 11/1975 | Greenhut | 200/246 |
| 3,978,303 | 8/1976 | Miyata | 200/283 |
| 4,063,056 | 12/1977 | Baker | 200/332 |
| 4,215,254 | 7/1980 | Ohki | 200/250 X |
| 4,346,272 | 8/1982 | Stoll | 200/159 A X |
| 4,394,553 | 7/1983 | Feil | 200/332 X |

FOREIGN PATENT DOCUMENTS

| | | | |
|---|---|---|---|
| 922312 | 3/1963 | United Kingdom | 200/332 |

*Primary Examiner*—Mark J. Thronson
*Assistant Examiner*—Ernest G. Cusick
*Attorney, Agent, or Firm*—Pearne, Gordon, McCoy & Granger

[57] ABSTRACT

A switch assembly includes an insulator base with two stationary contacts mounted on that base. A molded insulated tower and insulated post are unitary with the base and form a guide means and anchor means for a movable contact blade which has two movable contacts to engage the two stationary contacts. The tower has a unitary cap with a surface facing the base and a raised fulcrum on this facing surface. An actuator lever pivots on this raised fulcrum and moves the movable contact blade toward engagement of the pairs of contacts and establishes an over-travel means for the actuator lever after the contacts are in engagement.

23 Claims, 2 Drawing Sheets

SWITCH ASSEMBLY WITH UNITARY CONTACT GUIDE

This is a continuation, division, of application Ser. No. 843,240, filed on Mar. 24, 1986, now abandoned.

BACKGROUND OF THE INVENTION

A switch assembly has previously been manufactured wherein a base was made from a flat piece of insulation material which was die-cut to form the exterior shape and to punch a number of holes for rivets and the like. A contact blade was provided with dual movable contacts to engage dual stationary contacts. A movable blade was moved by an actuator lever. One end of the movable blade and actuator lever was contained inside a U-shaped bent sheet metal strap which was riveted to the insulator base. A metal post was disposed between the insulator base and the bight of the U and passed through apertures in the movable blade and actuator lever to retain those parts on the base. The actuator lever could move with an overtravel relative to the movable contact blade, and this switch mechanism was suitable for use in a centrifugally actuated apparatus to move the actuator lever between open and closed conditions of the switch contacts.

That prior art switch had a number of deficiencies, namely, a number of individual parts which had to be assembled and riveted, and hence requiring considerable labor content to manufacture. Also, the U-shaped sheet metal strap could not be made to a close tolerance because of the considerable variation in the thickness of the sheet metal from which the sheet metal strap was the U-shaped strap at the two ends of the bight always had a considerable radius; hence, the actuator lever had considerable loose motion in the width thereof relative to the width of the metal strap, which made for a considerable amount of sideplay of the actuator lever and movable contact blade.

SUMMARY OF THE INVENTION

The problem to be solved, therefore, is how to construct a switch mechanism which overcomes the deficiencies of the prior art.

This problem is solved by a switch assembly comprising, in combination, an insulator base having a first surface, a first stationary contact, means securing said first contact to said base with said first contact disposed on said first surface of said base, a tower unitary with said base and extending from said surface of said base, a cap unitary with said tower disposed above an aperture in said base, said tower cap having a facing surface facing said first surface of said base, an anchor axis substantially perpendicular to said base and extending from said tower cap facing surface toward said base aperture, a movable contact blade having an anchor end surrounding said anchor axis, a spring acting between said base and said movable blade adjacent said anchor axis, a first movable contact carried on said movable contact blade for make-and-break engagement with said first stationary contact, guide means unitary with said base for guided movement of said movable contact blade for alignment of said first movable contact with said first stationary contact, and actuator means actuatable on said movable contact blade to actuate same toward said base first surface against the urging of said spring to actuate said first movable contact relative to said first stationary contact.

The problem is further solved by a switch assembly comprising, in combination, an insulator base having a first surface, a first stationary contact mounted on said base, a unitary insulation post mounted on said first surface of said base, a movable contact blade having an aperture surrounding said post, a raised fulcrum on said base adjacent said post, a spring acting between said base and said movable blade adjacent said post and urging said movable blade towards said fulcrum, a first movable contact carried on said movable contact blade, guide means including said post and unitary with said base for make-and-break cooperation of said first movable contact with said first stationary contact, and actuator means actuable on said movable contact blade to actuate same against the urging of said spring to actuate said first movable contact relative to said first stationary contact.

Accordingly, an object of the invention is to provide a switch assembly with a molded insulator base wherein close tolerance of dimensions may be achieved for a more precise acting switch assembly.

Another object of the invention is to provide a switch assembly with a molded insulation base so that the number of parts is reduced and the labor for assembly is also considerably reduced.

Other objects and a fuller understanding of the invention may be had by referring to the following description and claims, taken in conjunction with the accompanying drawing.

DESCRIPTION OF THE PREFERRED EMBODIMENT

Figure 1:
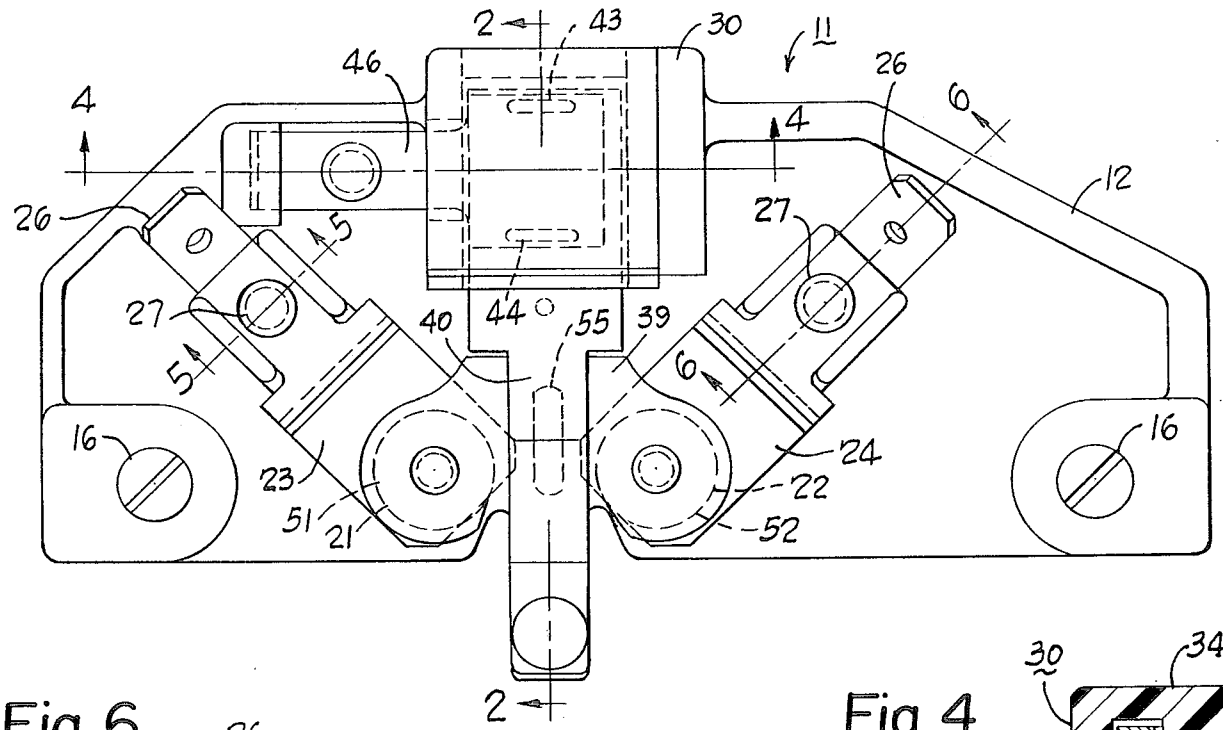
FIG. 1 is a plan view of the switch assembly incorporating the invention.

The figures of the drawing show the switch assembly 11 which includes an insulator base 12 which has first and second surfaces 13 and 14, respectively. The second surface 14 is adapted to be secured to some support structure 15, such as by metal mounting means on screws 16. This support 15 might be the interior of an electric motor, for example, such that the switch assembly 11 is actuated by a rotatable annular actuator 17, which may be moved axially of a motor shaft 18 between the positions 17 and 17A shown in FIGS. 2 and 3, respectively, by a centrifugal mechanism (not shown).

The base 12 is provided with a first stationary contact 21, and in this preferred embodiment is also provided with a second stationary contact 22. These contacts are mounted on first and second terminal strips 23 and 24, respectively, which are mounted on raised pedestals 25 on the base 12 and each provided with a terminal end such as a spade terminal 26. Each terminal strip is secured to the base by a metal fastener, e.g. a rivet or eyelet 27, which is recessed at 28 into the underside of the raised pedestal to increase the over-air insulation length between the eyelet and the mounting screw 16 or any metal mounting means.

An insulated tower 30 is unitary with the insulated base 12 and extends from the first surface 13 of the base generally perpendicular thereto. The tower has first and second side walls 31 and 32 and a rear wall 33. An insulated cap 34 is unitary with the tower 30 and has a facing surface 35 facing an aperture 36 in the base 12 at the base of the tower 30. An insulated post 37 is unitary with the insulated cap 34, and extends from the facing surface 35 toward the base aperture 36. This insulated post has an anchor axis 38 and anchors a movable contact blade 39 and an actuator lever 40 at anchor ends thereof by means of apertures 41 and 42, respectively, which surround this post 37. The facing surface 35 has a raised fulcrum 43 and a raised abutment 44 engaging the actuator lever 40. A spring 45 surrounds the post 37 and acts to urge the movable contact blade and actuator lever 40 toward the fulcrum 43. The opposite end of the spring 45 engages a retainer plate 46 which is cantilever-mounted on the first surface 13 of the base 12 and extends most of the way across the base aperture 36. The other end of this retainer plate 46 is caught underneath an engagement hook 47 unitary with the base 12, and the retainer plate is also secured by a rivet or eyelet 48 to the base. The retainer plate 46 has a raised hump 49 to center the spring 45.

The movable contact blade 39 carries first and second movable contacts 51 and 52, respectively, adapted for cooperation with the first and second stationary contacts 21 and 22, respectively. The movable contact blade 39 has a forked outer end to carry these two movable contacts. The base 12 has a raised voltage barrier 55 between the fixed contacts 21 and 22 to increase the voltage creep distance therebetween. The actuator lever 40 has an outer end 56 which is rounded for engagement by the movable actuator, which may be the rotatable annular actuator 17.

A raised, circular fulcrum 59 is provided on the movable contact blade 39 between it and the actuator lever 40. This circular fulcrum may be provided by a raised bump on one or the other, and it is shown as being raised from the movable contact blade 39. The raised fulcrum 43 and raised abutment 44 are approximately half or greater the width of the actuator lever 40, and the lever 40 and movable contact blade 39 have a width which is closely received between the first and second side walls 31 and 32 of the tower 30 for close control of the movement of these parts and contact stability from the rotating member.

Figure 4:
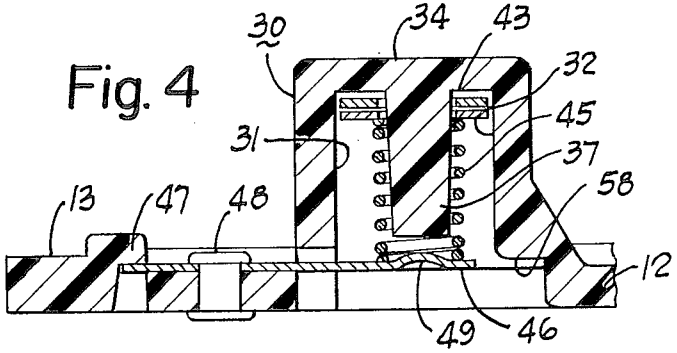
FIG. 4 is a sectional view on line 4—4 of FIG. 1.
Figure 5:
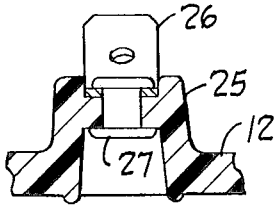
FIG. 5 is a sectional view on line 5—5 of FIG. 1.
Figure 6:
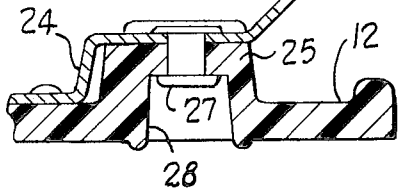
FIG. 6 is a sectional view on line 6—6 of FIG. 1.

The switch assembly 11 may be quickly and easily assembled with a minimum of labor time for such assembly. The end of the unitary post 37 terminates short of the base first surface 13, so that the actuator lever 40, and then the movable contact blade 39, may be slipped over this exposed end of the post. Next, the spring 45 is inserted and the retainer plate 46 inserted from right to left, as shown in FIG. 4. The tower 30 has a cutaway 58, as shown in FIG. 4, in order to aid this insertion of the retainer plate so that it slides under the engagement hook 47. This engagement hook keeps the retainer plate 46 temporarily in place despite the urging of the spring 45, and establishes that the spring acts between the base 12 and the contact blade 39 to urge the blade 39 and actuator lever 40 toward the raised fulcrum 43 and raised abutment 44. The stationary contacts 21 and 22 may be placed on the pedestals 25, and three eyelets 27 and 48 inserted and headed over to complete the assembly. Also, since the engagement hook 47 temporarily holds the retainer blade 46, the switch assembly may be assembled in two different stations, if desired, assembling at the first station the movable contact blade 39, actuator lever 40, spring 45, and retainer plate 46, and assembling at the second station the stationary contacts 21 and 22 and performing the three riveting or eyeleting operations.

Figure 2:
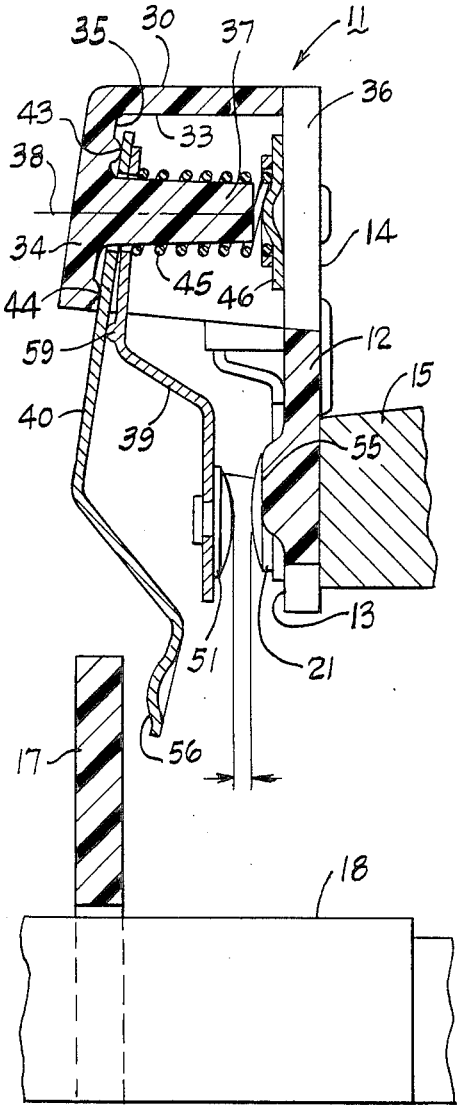
FIG. 2 is a sectional view on line 2—2 of FIG. 1.
Figure 3:
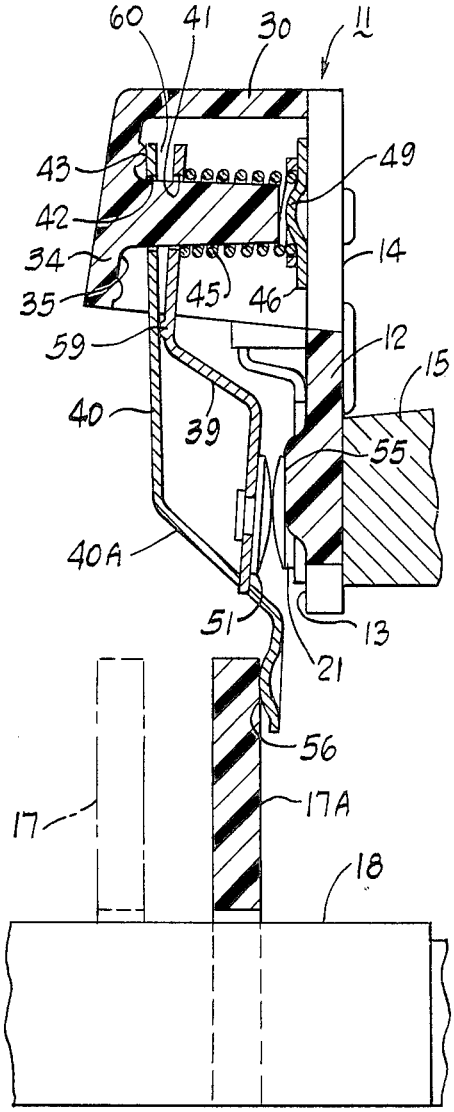
FIG. 3 is a view similar to FIG. 2, but with the switch assembly in the actuated condition.

FIG. 2 shows the switch assembly 11 in the nonactuated position, and FIG. 3 shows the assembly in the actuated condition, with the centrifugal actuator 17 moved to the right to the position 17A. In this condition, the actuator lever 40 has moved to a position 40A, pivoting about the raised fulcrum 43. The actuator lever 40 is established in its non-actuated position by engaging the raised fulcrum 43 and the raised abutment 44, as urged by the spring 45 and as shown in FIG. 2. About the first half of the movement to the right of the actuator lever 40 closes the movable contacts upon the stationary contacts, and then the switch assembly has overtravel means which is provided by the fact that the actuator lever 40 is separate from the movable contact blade 39. In the actuated position shown in FIG. 3, the actuator lever is in position 40A, and engages the movable contact blade fulcrum 59 to move it to the right, as shown in FIG. 3. Because this movable contact blade already has two-point engagement of the engaged contacts, this circular fulcrum 59 makes a three-point support or engagement so that the anchor end of the movable contact blade 39 separates from the anchor end of the actuator lever 40, as shown at 60 in FIG. 3. This is despite the urging of the stressed spring 45. This increases the contact engaging force between the movable and stationary contacts, and also there is provided a sliding engagement of these contacts for good wiping action to keep the contacts clean and free from projections due to arcing. This three-point support assures that both pairs of contacts will be firmly closed with equal pressure. Because the tower is molded as a unitary part with the base 12, the dimensions between the side walls 31 and 32 may be held very closely so that the lateral movement of the contact blade 39 and actuator lever 40 is kept to a minimum. The side walls 31 and 32 thus form guide means, together with the post 37, to guide the movement of the two movable parts.

The anchor axis 38 is substantially perpendicular to the base 12. The raised fulcrum 43 is closely adjacent the post 37 and anchor axis 38 for good control of the movement of the movable contact blade 39. The heights of the raised fulcrum 43 and raised abutment 44 may be controlled quite closely in the plastic molding process so that the tolerance in the lateral position of the outer end of the actuator lever 40 may be closely held. The width of the centrally disposed raised fulcrum 43 and raised abutment 44 is approximately one-half the width dimension of the movable contact blade 39 and actuator lever 40, and this is wide enough to keep these two movable parts normally parallel to the raised fulcrum 43, yet narrow enough so that they can tilt sideways slightly hence the ease of sideways tilting is enhanced. The tendency toward sideways tilting is induced because the centrifugally actuated annular actuator 17 rotates with the shaft 18, and the actuator lever 40 is non-rotatable relative to the shaft 18. This rotational drag during start-up of the motor tends to pull the rounded outer end 56 into or out of the plane of the paper of FIGS. 2 and 3, which tends to open one pair of contacts prior to the opening of the other pair. This width of the raised fulcrum 43 at about half the width of the actuator lever 40 has been found sufficient to provide smooth opening of the contacts without any contact chatter, which could cause arcing and pitting of the contacts.

The tower 30 is a means to support the unitary post 37 from the first side 13 of the base. It also permits the post to be directed toward that first surface so that the spring 45 urges the movable contacts away from the stationary contacts. The tower side walls are a guide means for the movable contact blade 39 and the post 37 is also a part of the guide or anchoring means to retain the parts on the entire switch assembly 11. The tower 30 is disposed over the base aperture 36, and this permits molding the tower 30 and post 37 as a unitary part of the base 12, yet utilizing only a two-part mold. This eliminates any re-entrant surfaces, simplifying and economizing the mold construction, and aids in the simple assembly of the entire switch assembly 11.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A switch assembly comprising, in combination:

an insulative base, tower, cap, and guide means of one piece of the same insulative material, said insulative base having a first surface and defining an aperture;

a first stationary contact;

means securing said first contact to said insulative base with said first contact disposed on said first surface of said insulative base;

said insulative tower extending from said first surface of said base;

said insulative cap disposed above said aperture in said insulative base;

said tower cap having a facing surface facing said first surface of said insulative base;

an anchor axis substantially perpendicular to said insulative base and extending from said tower cap facing surface toward said base aperture;

a movable contact blade having an anchor end surrounding said anchor axis;

a spring acting between said insulative base and said movable blade adjacent said anchor axis;

a first movable contact carrier on said movable contact blade for make-and-break engagement with said first stationary contact;

said insulative guide means for guiding movement of said movable contact blade for alignment of said first movable contact with said first stationary contact; and actuator means actuable on said movable contact blade to actuate same toward said insulative base first surface against the urging of said spring to actuate said first movable contact relative to said first stationary contact for said make-and-break cooperation.

2. A switch assembly as set forth in claim 1, wherein said actuator means is an actuator lever having an anchor end surrounding said anchor axis.

3. A switch assembly as set forth in claim 2, including a raised fulcrum on said facing surface for said actuator lever.

4. A switch assembly as set forth in claim 3, wherein said actuator lever has a width dimension and said raised fulcrum is centrally disposed relative to the width dimension of said actuator lever.

5. A switch assembly as set forth in claim 4, wherein said raised fulcrum has a width approximately half the width of said actuator lever.

6. A switch assembly as set forth in claim 1, wherein said insulative tower is a part of said insulative guide means.

7. A switch assembly as set forth in claim 1, including a second stationary contact secured to said insulative base and a second movable contact carried on said movable blade for cooperation with said second stationary contact.

8. A switch assembly as set forth in claim 1, including an insulator post unitary with said insulative base at said anchor axis, and with said movable blade anchor end having an aperture disposed on said post.

9. A switch assembly as set forth in claim 8, wherein said insulative post is a part of said insulative guide means.

10. A switch assembly comprising, in combination;

an insulative base having a first surface and defining an aperture;

a first stationary contact;

means securing said first contact to said base with said first contact disposed on said first surface of said base;

a tower unitary with said base and extending from said first surface of said base;

a cap unitary with said tower disposed above said aperture in said base;

said tower cap having a facing surface facing said first surface of said base;

an anchor axis substantially perpendicular to said base and extending from said tower cap facing surface toward said base aperture;

a movable contact blade having an anchor end surrounding said anchor axis;

a spring acting between said base and said movable blade adjacent said anchor axis;

a first movable contact carried on said movable contact blade for make-and-break engagement with said first stationary contact;

guide means unitary with said base for guided movement of said movable contact blade for alignment of said first movable contact with said first stationary contact;

actuator means actuable on said movable contact blade to actuate same toward said base first surface against the urging of said spring to actuate said first movable contact relative to said first stationary contact;

a retention plate extending at least part way across said base aperture and engaging said spring; and an engagement hook unitary with said insulative base to engage and restrain said retention plate.

11. A switch assembly as set forth in claim 10, including a rivet securing said retention plate to said insulative base.

12. A switch assembly comprising, in combination:

an insulative base, post, and guide means of one piece of the same insulative material, said base having a first surface;

a first stationary contact mounted on said base;

said insulative post mounted on said first surface of said insulative base;

a movable contact blade having an aperture surrounding said post;

a raised fulcrum on said insulative base adjacent said post;

a spring acting between said insulative base and said movable blade adjacent said post and urging said movable blade towards said fulcrum;

a first movable contact carried on said movable contact blade;

said insulative guide means including said post for establishing make-and-break cooperation of said first movable contact with said first stationary contact; and actuator means actuable on said movable contact blade to actuate same against the urging of said spring to actuate said first movable contact relative to said first stationary contact for said make-and-break cooperation.

13. A switch assembly as set forth in claim 12, including a facing surface unitary with said insulative base and facing said first surface of said insulative base, and said raised fulcrum being mounted on said facing surface.

14. A switch assembly as set forth in claim 12, including over-travel means between said actuator means and said movable contact.

15. A switch assembly as set forth in claim 12, including a second stationary contact on said insulative base and a second movable contact on said movable contact blade.

16. A switch assembly as set forth in claim 12, wherein said spring is a coil compression spring surrounding said post insulative post.

17. A switch assembly as set forth in claim 12, including an insulative tower of one piece with said insulative base, a facing surface on said insulative tower facing said first surface on said insulative base, and said raised fulcrum being provided on said facing surface.

18. A switch assembly as set forth in claim 17, wherein said guide means includes a part of said insulative tower.

19. A switch assembly as set forth in claim 12, wherein said actuator means is an actuator lever with an aperture received on said insulative post.

20. A switch assembly as set forth in claim 19, wherein said actuator lever is disposed between said movable contact blade and said raised fulcrum.

21. A switch assembly as set forth in claim 20, wherein said raised fulcrum is narrower than said actuator lever to enhance the lose of sideways tilting of said movable contact blade.

22. A switch assembly as set forth in claim 12, including a metal mounting means to secure said insulative base to an electrical motor, said insulative base having a recess;

a metal fastener in said recess securing said stationary contact to said insulative base so as to increase the over-air insulation length between the fastener and the mounting means.

23. A switch assembly comprising, in combination:

a base constructed from a unitary piece of insulative material and having a first surface;

a first stationary contact mounted on said base;

a unitary insulative post mounted on said first surface of said insulative base;

a movable contact blade having an aperture surrounding said post;

a raised fulcrum on said insulative base adjacent said post;

a spring acting between said insulative base and said movable blade adjacent said post and urging said movable blade towards said fulcrum.

a first movable contact carried on said movable contact blade;

insulative guide means including said post and unitary with said insulative base for establishing make-and-break cooperation of said first movable contact with said first stationary contact;

actuator means actuable on said movable contact blade to actuate same against the urging of said spring to actuate said first movable contact relative to said first stationary contact for said make-and-break cooperation; and a raised abutment on said insulative base adjacent said insulative post and on the side of said post opposite from said raised fulcrum, wherein said spring, said raised fulcrum and said raised abutment establish said movable contact blade in a non-actuated position.

* * * * *

UNITED STATES PATENT AND TRADEMARK OFFICE

CERTIFICATE OF CORRECTION

PATENT NO. : 4,743,723

DATED : May 10, 1988

INVENTOR(S) : Lee A. Seabeck

It is certified that error appears in the above-identified patent and that said Letters Patent is hereby corrected as shown below:

Assignee: "Torg Corporation" should be --Torq Corporation--

Col. 1, line 33, after "was", insert --stamped and formed. Still further, the inside corners of--.

Col. 5, line 4, after "base" insert --12--

Col. 8, line 6, Claim 21, "lose" should read as --ease--

Signed and Sealed this

Thirtieth Day of August, 1988

*Attest:*

DONALD J. QUIGG

*Attesting Officer*

*Commissioner of Patents and Trademarks*